US006516765B1

(12) United States Patent
Becker, Jr.

(10) Patent No.: US 6,516,765 B1
(45) Date of Patent: Feb. 11, 2003

(54) PASSIVELY ROTATING VALVE

(75) Inventor: Theodore H. Becker, Jr., Chillicothe, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 10/068,415

(22) Filed: Feb. 5, 2002

(51) Int. Cl.[7] ..... F01L 1/32
(52) U.S. Cl. ..... 123/90.28; 123/188.9
(58) Field of Search ..... 123/188.2, 188.3, 123/188.9, 188.5, 90.28, 90.29, 90.3

(56) References Cited

U.S. PATENT DOCUMENTS

| | | | | |
|---|---|---|---|---|
| 1,183,852 A | | 5/1916 | Buck | 123/90.28 |
| 1,244,287 A | | 10/1917 | Buck | 123/90.28 |
| 1,550,530 A | | 8/1925 | Flynn et al. | 123/90.28 |
| 1,726,259 A | | 8/1929 | Daisley | 123/90.28 |
| 2,609,804 A | | 9/1952 | Doughty | 123/90.28 |
| 3,037,494 A | | 6/1962 | Kirkpatrick et al. | 123/188.9 |
| 3,585,974 A | | 6/1971 | Weber | 123/90.12 |
| 4,309,966 A | | 1/1982 | Klomp | 123/90.28 |
| 4,768,479 A | * | 9/1988 | Kammeraad | 123/188.9 |

* cited by examiner

*Primary Examiner*—Noah P. Kamen
(74) *Attorney, Agent, or Firm*—Taylor & Aust.

(57) ABSTRACT

A valve arrangement includes a valve member that rotates within a valve guide such that a frictional wear area is unlikely to occur on a discrete location of the valve stem and/or the valve guide. The valve guide includes a bore, the bore defining a longitudinal axis and a helical bore groove. The valve member includes a valve head and a stem, the stem being guided for reciprocal movement within the valve guide. The valve stem reciprocates within the valve bore and includes a helical stem groove. As the valve stem reciprocates within the valve bore, the helical bore groove and the helical stem groove interact to impart an axial rotation to the valve member about the longitudinal axis.

18 Claims, 2 Drawing Sheets

PASSIVELY ROTATING VALVE

TECHNICAL FIELD

The present invention relates to a valve for internal combustion engines, and more particularly to an intake and/or exhaust valve which passively rotates in operation so as to create an improvement in valve life.

BACKGROUND

Induction valves, including intake as well as exhaust valves, for internal combustion engines are normally of the poppet type valve. Each such poppet valve includes a valve head adapted to seat against a valve seat in the cylinder head of the engine. The valve reciprocates to control the flow of induction fluid through an intake passage in the cylinder head to a cylinder of the engine during the induction cycle for that cylinder. Normally, the valve head of such a poppet valve is constituted as a body of revolution about an axis and is provided with a stem extending coaxially with this axis. The stem of the poppet valve is reciprocally journaled in a suitable valve stem guide bore provided in the cylinder head. The free end of the stem of the valve normally projects from the cylinder head a suitable distance so that it can be engaged by a suitable actuator device, such as a rocker arm, to effect a reciprocating movement of the poppet valve in an opening direction. A valve return spring is used to effect reciprocating movement of the poppet valve in an opposite or valve closing direction.

In such a conventional type valve, the continual high speed reciprocation of the valve creates a great amount of frictional wear on the valve face and seating surface. Additionally, deposits tend to accumulate upon such surfaces, which can contribute to the frictional wear of such surfaces and/or to a reduction in the operating efficiency of the engine. Accordingly, various ways have been used in the prior art to increase the life of the valves. One such method is that of inducing valve rotation within the guide bore during reciprocation. However, this rotation has been accomplished by mechanical arrangements which are expensive, provide inadequate reliability and are complex.

The present invention is directed to overcoming one or more of the problems as set forth above.

SUMMARY OF THE INVENTION

The present invention overcomes the disadvantages described above by providing a valve assembly having a valve member that rotates within a valve guide without the necessity of additional mechanical components.

The valve assembly of the present invention includes a valve guide and a valve member to control the flow of an induction fluid through an intake passage of the cylinder head. The valve guide provides a bore defining a longitudinal axis and includes a helical bore groove. The valve member includes a valve head and a stem having a helical stem groove. The valve member is guided for reciprocal movement within the guide such that the valve head reciprocates between an open and a closed position in relation to a valve seat. The helical bore groove and the helical stem groove interact to impart an axial rotation to the valve member about the longitudinal axis.

The valve guide includes a rifled-like bore and the valve stem includes a helical stem groove of a higher lead. Preferably, the helical stem groove defines a lead approximately 150% the lead of the helical bore groove. A lubricating fluid, as commonly provided to moving parts of an engine, lubricates the interaction of the valve bore and valve stem. The lubricating fluid creates a hydrodynamic film between the valve bore and valve member which, in relation to the interaction of the helical grooves, results in a highly effective axial rotation of the valve member within the valve guide. This axial rotation, although relatively predictable, is sufficiently random such that a frictional wear area is unlikely to occur on a discrete location of the valve stem or valve guide.

The present invention therefore provides an uncomplicated and inexpensive valve assembly which can be adapted to existing valve assemblies. The reduced frictional wear between the valve guide and valve member results in a high degree of operational reliability and durability.

DETAILED DESCRIPTION

Figure 1:
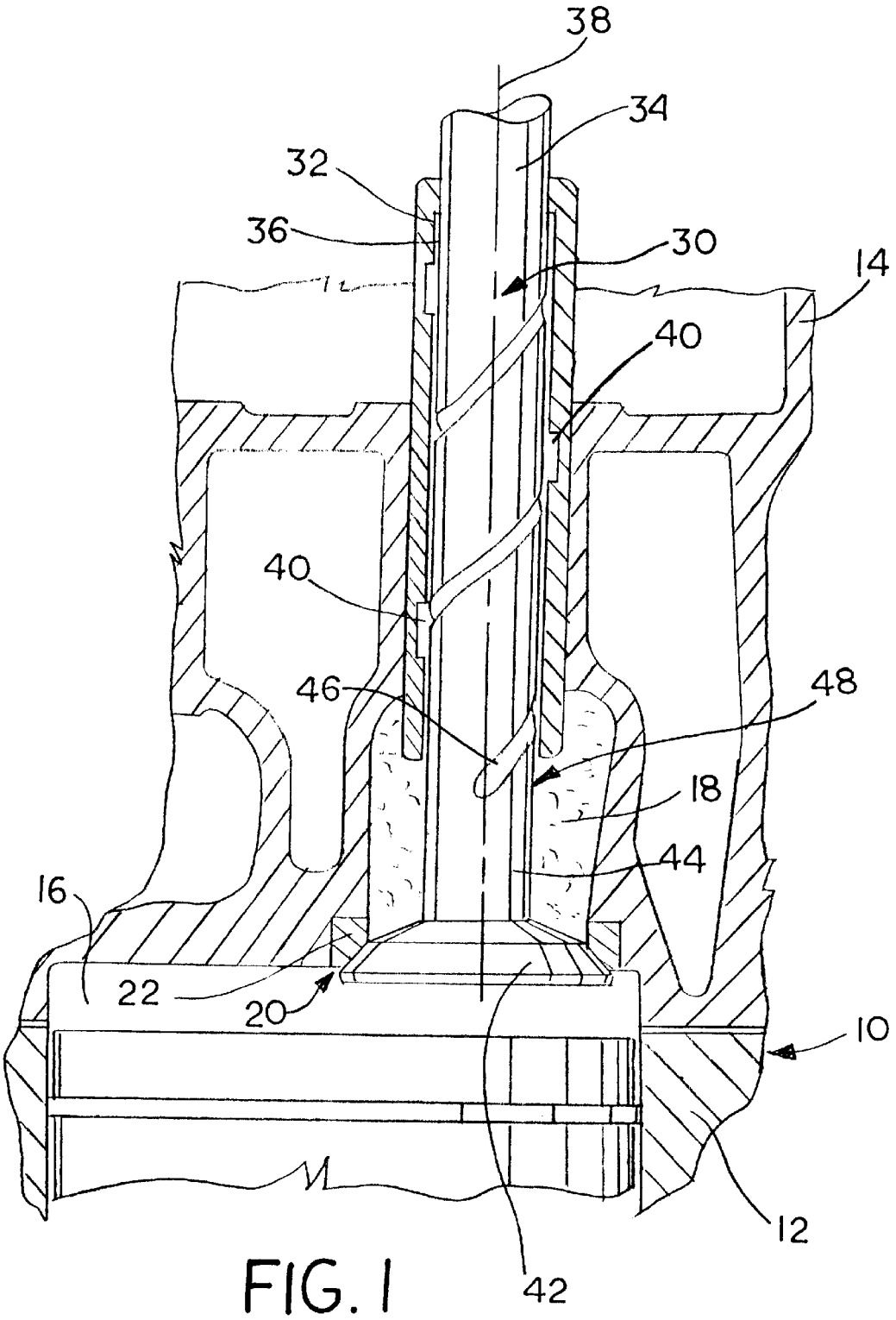
FIG. 1 is a partial cut-away view of a cylinder head including the valve assembly of the present invention.

FIG. 1 illustrates a portion of an internal combustion engine having an engine cylinder block (partially shown) with at least one cylinder 10 therein defined by an internal cylindrical bore wall 12 formed in the cylinder block. Cylinder 10 reciprocally receives a piston (partially shown). Closing the end of cylinder 10 is a cylinder head 14 that is suitably secured to the cylinder block. Cylinder 10, the corresponding piston and cylinder head 14 cooperate to define a variable volume combustion chamber 16.

As shown in FIG. 1, cylinder head 14 is provided with an induction system, in relation to one of intake and exhaust, that includes an induction passage 18 which would have the usual entrance portion at its upstream end opening from an outer surface (not shown) of cylinder head 14 which is adapted to receive a manifold (not shown). At its opposite end, induction passage 18 terminates at an annular induction port 20 opening into combustion chamber 16, with flow therefrom controlled by an induction valve arrangement 30 in accordance with the present invention. Induction port 20 presents an annular valve seat 22 which, in a conventional manner, is chamfered or beveled at a suitable angle to the axis of induction port 20, as desired, on the side of cylinder head 14 adjacent to variable volume combustion chamber 16.

Valve arrangement 30 of the present invention generally includes a valve guide 32 and a valve member 34. Valve guide 32 includes a bore 36 defining a longitudinal axis 38 and includes a helical bore groove 40. Valve member 34 includes a valve head 42 and a stem 44 having helical stem groove 46. Valve member 34 is guided for reciprocal movement within valve guide 32 such that helical bore groove 40 and helical stem groove 46 interact. This interaction imparts an axial rotation to the valve member 34 about the longitudinal axis 38 such that valve member 34 rotates within valve guide 32 without the necessity of mechanical component interaction.

As shown in FIG. 1, bore 36 can be provided in a separate valve stem guide that is suitably secured to cylinder head 14 or, as is well known in the art, bore 36 can be integrally provided in cylinder head 14.

Figure 2:
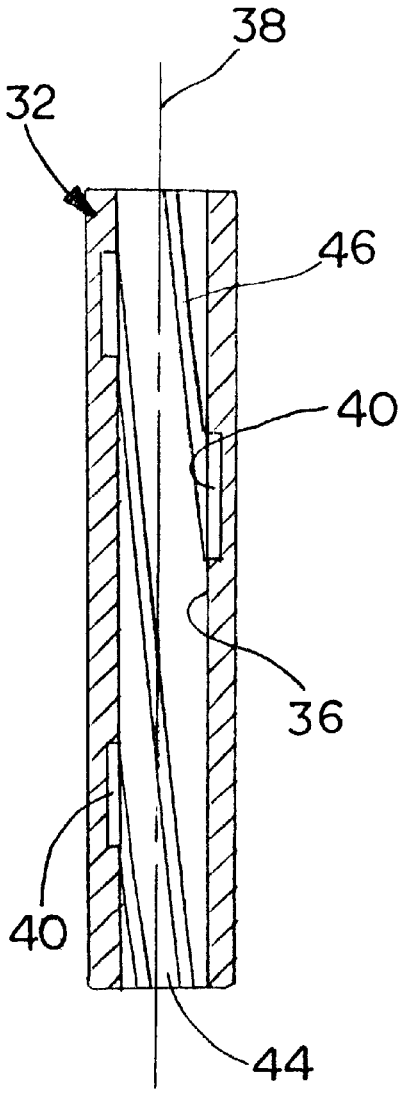
FIG. 2 is a cut-away view of the valve guide according to the present invention.

FIG. 2 illustrates a cut-away view of valve guide 32 of the present invention. Valve bore 36, defining a longitudinal axis 38, includes helical bore groove 40. As shown in FIG. 2, helical bore groove 40 can include a plurality of independent bore groves 40 along longitudinal axis 38. Preferably, bore groves 40 are oriented to define a rifled-like bore for receipt of valve stem 44.

Figure 3:
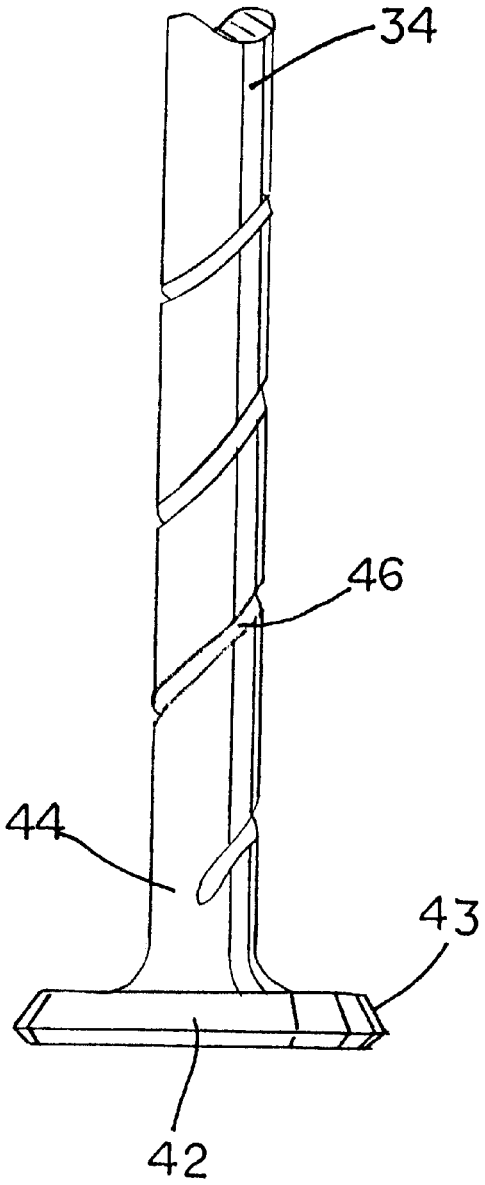
FIG. 3 is a plan view of the valve member according to the present invention.

Referring now to FIG. 3, a partial plan view of valve member 34 is illustrated. Valve member 34 includes valve head 42 and stem 44. Valve stem 44 extends concentrically from valve head 42 and thus its axis is co-axial with the axis of valve head 42. Valve stem 44 further includes helical stem groove 46 in accordance with the present invention. In the embodiment illustrated, an outer peripheral rim of valve head 42 is provided with a beveled seating portion 43 adapted to seat against valve seat 22 in inlet port 20 of cylinder head 14.

A suitable drive device (not shown) is associated with each of cylinder head 14 and valve member 34 to effect reciprocating movement of valve member 34 in a known manner. Again with reference to the embodiment shown in FIG. 1, valve guide 32 preferably includes a rifled-like bore 36, and valve stem 44 includes a helical stem groove 46 of a higher lead.

A lubricating fluid shown schematically at 48 clings to valve stem 44 and is drawn into valve guide 32 via reciprocating motion, thereby lubricating the interaction of valve bore 36 and valve stem 44. Lubricating fluid 48 additionally creates a hydrodynamic film between valve bore 36 and valve stem 44 which, due to the interaction of helical grooves 40,46, results in a highly effective axial rotation of valve member 34 within valve guide 32. This axial rotation, although relatively predictable, is sufficiently random such that a frictional wear area is unlikely to occur on a discrete location of valve stem 44 or valve guide 32. Preferably, helical stem groove 46 defines a lead approximately 150% the lead of helical bore groove 40. However, one skilled in the art will realize that in accordance with the present invention, various helical grooves, ratios, and orientations can be provided on bore 36 and stem 44 to reduce frictional wear between valve guide 32 and valve member 34 which thus results in a high degree of operational reliability and durability.

INDUSTRIAL APPLICABILITY

Valve arrangement 30 of the present invention includes valve guide 32 and valve member 34 to control the flow of an induction fluid through induction passage 18 of cylinder head 14. Valve member 34 is guided for reciprocal movement within guide 32 such that valve head 42 reciprocates between an open and a closed position in relation to valve seat 22. Helical bore groove 40 and helical stem groove 46 interact to impart an axial rotation to valve member 34 about longitudinal axis 38. This interaction is such that valve member 34 rotates within valve guide 32 without the necessity of mechanical component interaction.

Lubricating fluid 48 creates a hydrodynamic film between valve bore 36 and valve member 34 which, in relation to the interaction of helical grooves 40 and 46, results in a highly effective axial rotation of valve member 34 within valve guide 32. This axial rotation, although relatively predictable, is sufficiently random such that a frictional wear area is unlikely to occur on a discrete location of valve stem 44 and/or valve guide 32.

Other aspects, objects and advantages of this invention can be obtained from a study of the drawings, the disclosure and the appended claims.

What is claimed is:

1. A valve arrangement, comprising:

a valve guide having a bore defining a longitudinal axis, said bore including a helical bore groove; and a valve member having a valve head and a stem, said stem including a helical stem groove, said valve member guided for reciprocal movement within said valve guide, said stem being reciprocable within said bore such that said valve head is reciprocable between an open and a closed position in relation to a valve seat;

said helical bore groove and said helical stem groove interacting to impart an axial rotation to said valve member about said longitudinal axis.

2. The valve arrangement according to claim 1, wherein said bore includes a plurality of helical bore grooves.

3. The valve arrangement according to claim 1, wherein said bore includes a plurality of bore grooves oriented to define a rifled bore.

4. The valve arrangement according to claim 1, wherein said helical stem groove is a single continuous groove.

5. The valve arrangement according to claim 1, wherein said helical bore groove and said helical stem groove revolve in the same direction.

6. The valve arrangement according to claim 1, further including a lubrication fluid between said valve guide and said valve member.

7. The valve arrangement according to claim 6, wherein said lubrication fluid is circulatable between said valve guide and said valve member.

8. The valve arrangement according to claim 1, wherein said helical stem groove has a lead approximately 150% of the lead of said helical bore groove.

9. A cylinder assembly for an internal combustion engine, comprising:

a cylinder head and a variable volume combustion chamber, said cylinder head defining a valve seat adjacent said combustion chamber;

a valve arrangement including a valve guide within said cylinder head, said valve guide having a bore defining a longitudinal axis, said bore including a helical bore groove; and a valve member having a valve head and a stem including a helical stem groove, said valve member guided for reciprocal movement within said guide, said stem being reciprocable within said bore such that said valve head is reciprocable between an open and a closed position in relation to said valve seat; and said helical bore groove and said helical stem groove interact to impart an axial rotation to said valve member about said longitudinal axis.

10. The cylinder assembly according to claim 9, wherein said valve guide is integral to said valve head.

11. The cylinder assembly according to claim 9, wherein said bore includes a plurality of helical bore grooves.

12. The cylinder assembly according to claim 9, wherein said bore includes a plurality of helical bore grooves oriented to define a rifled bore.

13. The cylinder assembly according to claim 9, wherein said helical stem groove is a single continuous groove.

14. The cylinder assembly according to claim 9, further including a lubrication fluid between said valve guide and said valve member.

15. The cylinder assembly according to claim 9, wherein said helical stem groove has a lead approximately 150% of said helical bore groove.

16. A cylinder assembly for an internal combustion engine, comprising:

a cylinder head adjacent to a variable volume combustion chamber, said cylinder head defining a valve seat;

a valve arrangement including a valve guide within said cylinder head, said valve guide having a rifled bore defining a longitudinal axis, said rifled bore defined by a plurality of helical bore grooves;

a valve member having a valve head and a stem, said stem including a single continuous helical stem groove, said valve member guided for reciprocal movement within said guide, said stem being reciprocable within said bore such that said valve head is reciprocable between an open and a closed position in relation to said valve seat; and a lubrication fluid between said valve guide and said valve member;

said helical bore groove, said helical stem groove and said lubrication fluid interacting to impart an axial rotation to said valve member about said longitudinal axis.

17. The cylinder assembly according to claim 16, wherein said lubrication fluid is circulatable between said valve guide and said valve member.

18. The cylinder assembly according to claim 16, wherein said helical stem groove has a lead approximately 150% of said helical bore groove.

* * * * *